US005333751A

United States Patent [19]

Santucci, Sr.

[11] Patent Number: 5,333,751

[45] Date of Patent: Aug. 2, 1994

[54] MUSHROOM DISPLAY TRAY AND PACKAGE

[75] Inventor: Vincent J. Santucci, Sr., West Grove, Pa.

[73] Assignee: Elite Mushroom Company, Inc., Avondale, Pa.

[21] Appl. No.: 949,722

[22] Filed: Sep. 23, 1992

[51] Int. Cl.[5] ..... B65D 1/24; B65D 85/50

[52] U.S. Cl. ..... 220/512; 206/45.33; 206/423; 206/521.6; 220/510; 229/120.32

[58] Field of Search ..... 206/45.33, 366, 423, 206/521.6, 521.7, 561, 562, 563; 220/507, 510, 512, 543; 229/120.32

[56] References Cited

U.S. PATENT DOCUMENTS

| | | | |
|---|---|---|---|
| 1,199,987 | 10/1916 | Husted | 206/562 |
| 1,499,165 | 6/1924 | France | 206/423 |
| 1,744,552 | 1/1930 | Katzinger | 220/507 |
| 1,904,072 | 4/1933 | Nelson et al. | 206/423 |
| 2,264,313 | 12/1941 | Humphrey | 206/366 |
| 2,456,610 | 12/1948 | Baker | 206/562 |
| 3,160,306 | 12/1964 | Smalley | 220/512 |
| 3,297,191 | 1/1967 | Eastman | 220/512 |
| 3,643,812 | 2/1972 | Mander et al. | 220/512 |
| 3,667,159 | 6/1972 | Todd | 220/507 |
| 3,767,104 | 10/1973 | Bachman et al. | 206/423 |
| 3,874,548 | 4/1975 | Buff, Jr. | 220/510 |
| 3,955,704 | 5/1976 | Smith et al. | 220/507 |
| 4,568,017 | 2/1986 | Grunert | 206/45.33 |
| 5,004,103 | 4/1991 | Connors et al. | 206/563 |

FOREIGN PATENT DOCUMENTS

| | | | |
|---|---|---|---|
| 221414 | 5/1962 | Austria | 220/507 |
| 35914 | 3/1930 | France | 206/562 |

*Primary Examiner*—Gary E. Elkins
*Attorney, Agent, or Firm*—Neil F. Markva

[57] ABSTRACT

A display tray for use in a package of mushrooms comprises an upper mushroom crown-displaying portion and a lower mushroom stem-containing portion. The crown-displaying portion includes an outer peripheral edge section and a mushroom crown-supporting surface around each of a plurality of stem-receiving holes. A flange structure extends around the edge section and defines a matrix around the mushroom crown-supporting surface. The plurality of holes defines a mushroom weight-correlated hole design whereby, when all of the holes each receives a single mushroom, a preselected total net weight of the mushrooms is substantially consistently maintained from one mushroom tray to the next. The lower stem-containing portion includes a closed, liquid impervious wall structure defining a mushroom stem-containing chamber for receiving each mushroom stem that extends through each of the holes of the weight-correlated design.

20 Claims, 4 Drawing Sheets

MUSHROOM DISPLAY TRAY AND PACKAGE

FIELD OF THE INVENTION

This invention relates to a mushroom display tray for extending the shelf-life of packaged mushrooms. More particularly, the invention relates to a tray for containing whole mushrooms during storage and transportation in a package overwrapped with flexible transparent material.

BACKGROUND OF THE INVENTION

U.S. Pat. Nos. 3,660,934; 3,810,329; 3,924,354; 4,170,301; 4,189,868; 4,292,760; 4,329,813 disclose various types of packages used for transporting, shipping, and displaying plant products for the commercial market. These patents show known trays and transparent packages for plants.

U.S. Pat. Nos. 3,242,614 and 4,311,477 disclose packaging for growing and cultivating mushrooms. While mushrooms are grown with their root systems intact in these known packages, no specific correlation exists between the amount and weight of mushrooms for the consumer to use in these known packages. The consumer has no guarantee of the available weight of mushrooms in these prior art packages or that they will produce a preselected mushroom weight for the consumer's use.

Mushrooms are generally packaged in bulk by placing the whole mushrooms onto a flat tray overwrapped with a thin, flexible heat-sealable material. The processor picks the mushrooms from the growing bed, cuts the root system from the bottom of the stem, and places the various size mushrooms in a tray that is overwrapped to form a bulk package. The packaged mushrooms are then shipped to a warehouse and on to the store for the consumer to purchase.

The shelf-life of mushrooms is substantially ended when they begin to turn brown. Despite careful handling of the mushrooms during the processing and the expeditious transportation of mushrooms from the processing plant to the retail store in known packages, an extended packaged mushroom shelf-life is still desired.

Present mushroom handling procedures involve the gathering of five or six mushrooms in the picker's hand, cutting off the root system, and placing them into the tray container. Bruising of the mushrooms frequently occurs when the worker holds the mushrooms and when the bulk container is carried into the packing plant handled again in the weighing process. When the stem is separated from the root system, the mushroom begins to dehydrate through the cut stem. Bruising of a mushroom shortens its shelf-life in either a bulk condition or an overwrapped package condition.

PURPOSE OF THE INVENTION

The primary object of this invention is to produce a mushroom tray and package that will extend the shelf-life of the mushrooms at the point of consumer purchase.

Another object of the invention is to decrease the amount of handling required upon picking the mushrooms from the bed and placing them into a container for use in combination with an overwrap material.

A further object of the invention is to provide a means for reducing the time required to package mushrooms from a bed into a transparent overwrapped package.

A still further object of the invention is to provide a package of whole mushrooms including the crown, stem, and root system placed in a tray while maintaining a guaranteed preselected weight to the purchasing consumer.

Another object of the invention is to provide a package for extending the shelf-life of mushrooms by providing nutrient material in a stem-containing chamber for the root system of the packaged whole mushrooms.

Another object of the invention is to provide a mushroom tray having a completely closed stem-containing chamber, which will retain moisture and preclude drying of the mushroom root system.

A still further object of this invention is to provide a package for storage and shipment of a preselected total net weight of live whole mushrooms that is substantially consistently maintained from one mushroom package to the next for the consumer.

A still further object of this invention is to shorten the time from picking to vacuum cooling refrigeration by bypassing the re-handling and weighing operation, thereby improving and extending shelf life.

SUMMARY OF THE INVENTION

This invention is directed to a display tray comprising an upper mushroom crown-displaying portion and a lower mushroom stem-containing portion. The upper mushroom crown-displaying portion includes an outer peripheral edge section and a mushroom crown-supporting surface disposed around each of a plurality of mushroom stem-receiving holes.

The outer peripheral edge section includes an upwardly extending flange means that defines a matrix around the mushroom crown-supporting surface. In a specific embodiment, the upper and lower tray portions are integrally formed and composed of rigid material. The matrix forms a rectangle having two long sides and two short sides.

The plurality of mushroom stem-receiving holes defines a mushroom weight-correlated hole design whereby, when all of the holes each receive a single mushroom, a preselected total net weight of the mushrooms is consistently maintained from one mushroom-filled tray to the next. In specific embodiments of the weight-correlated design, an unexpected weight correlation with the total number of mushrooms exists whereby a sixteen hole design produces a ten ounce net weight package of mushrooms, a thirteen hole design produces an eight ounce net weight package of mushrooms, and a ten hole design produces a six ounce net weight package of mushrooms. In each instance, the six, eight and ten ounce net weights do not include the root system and the nutrients and soil particles associated with that root system.

The lower mushroom tray stem-containing portion includes closed, liquid impervious wall means defining a mushroom stem-containing chamber for receiving each mushroom stem that extends through a hole in the weight-correlated hole design. The mushroom stems also extend from a mushroom crown disposed contiguously to a mushroom crown-supporting surface within the matrix formed by the flange means.

According to one feature of the invention, wall means defines a single chamber, which contains all the mushroom stems that project through each respective hole in the weight-correlated hole design. In a specific embodiment, the flange means and wall means define a single unitary tray including shoulder means located between the flange means and the wall means. The shoulder means is effective to bearingly suspend a rigid planar mushroom crown-supporting element over the lower tray portion to define the mushroom stem-containing chamber below. The mushroom crown-supporting element includes the plurality of mushroom stem-receiving holes in the weight-correlated hole design.

Another feature of the invention is directed to a tray structure including upper and lower tray portions that define a unitary tray structure having a planar base member with a peripheral upwardly extending flange means. The plurality of holes are laterally spaced with respect to each other across the planar base member. Wall means includes a peripheral wall structure projecting downwardly from the circumference of each base member hole to form a closed chamber for each of the holes in the weight-correlated design. In a specific embodiment, each peripheral wall structure includes a continuous, liquid impervious trapezoidal wall with the base member hole defining the outer circumference of a trapezoidal base. Each individual wall structure extends outwardly from the base member for a distance sufficient to receive the stem and root system of a whole mushroom.

Another feature of the invention is that the tray is a rigid injection molded plastic material. Each juxtaposed hole in the weight-correlated design is sufficiently spaced along the base member to form a rim section around each hole. Each rim section is effective to support the bottom edge of a mushroom crown around each hole.

Another feature of the invention is directed to the weight-correlated hole design, which enables the unexpected result of preparing a preselected total net weight of mushrooms in a substantially consistent manner from one tray of mushrooms to the next. The weight-correlated design includes sixteen holes to produce a package having a ten ounce net weight of mushrooms, thirteen holes to produce an eight ounce net weight package of mushrooms, and ten holes to produce a six ounce net weight package of mushrooms.

In a rectangular matrix defined by flange means, the weight-correlated design includes three rows of holes disposed parallel to the long sides of the rectangle. In a specific embodiment, all the holes of each row of holes have the same diameter except for the hole at each end of the middle row of holes. These two end holes have a substantially identical diameter that is smaller than the diameter of the remaining holes in the three rows of holes.

The rigid mushroom-containing tray provides an improvement in a package overwrapped by a thin, flexible transparent wrapping material. The heat sealable wrapping material is disposed contiguously over the mushroom caps disposed in the tray, is wrapped around the flange means, and is heat sealed along the lower stem-containing portion of the tray. In a specific embodiment of the improvement, the wrapping material includes an opaque portion that registers with the outer peripheral edge section to display only the mushroom crowns while masking the tray edge section from view.

A container for the storage and transportation of mushrooms comprises a base member having an outer peripheral edge portion, a plurality of holes, a mushroom crown-supporting surface, and a mushroom stem-containing means. The outer peripheral edge portion includes flange means extending along the outer periphery of the base member and projecting outwardly from the mushroom crown-supporting surface.

Each juxtaposed hole is spaced from each adjacent hole along the mushroom crown-supporting surface to define a rim section around each hole. Closed wall means project downwardly from the base member along the entire periphery of each hole to thereby define a plurality of closed chambers for containing the mushroom stems that extend through the holes with the lower edge of the mushroom crowns resting against the crown-supporting surface. The liquid impervious wall means is effective to hold nutrient material for a mushroom having its stem projecting into the closed chamber of the container.

BRIEF DESCRIPTION OF DRAWINGS

Other objects of this invention will appear in the following description and appended claims, reference being made to the accompanying drawings forming a part of the specification wherein like reference characters designate corresponding parts in the several views.

DETAILED DESCRIPTION

Figure 1:
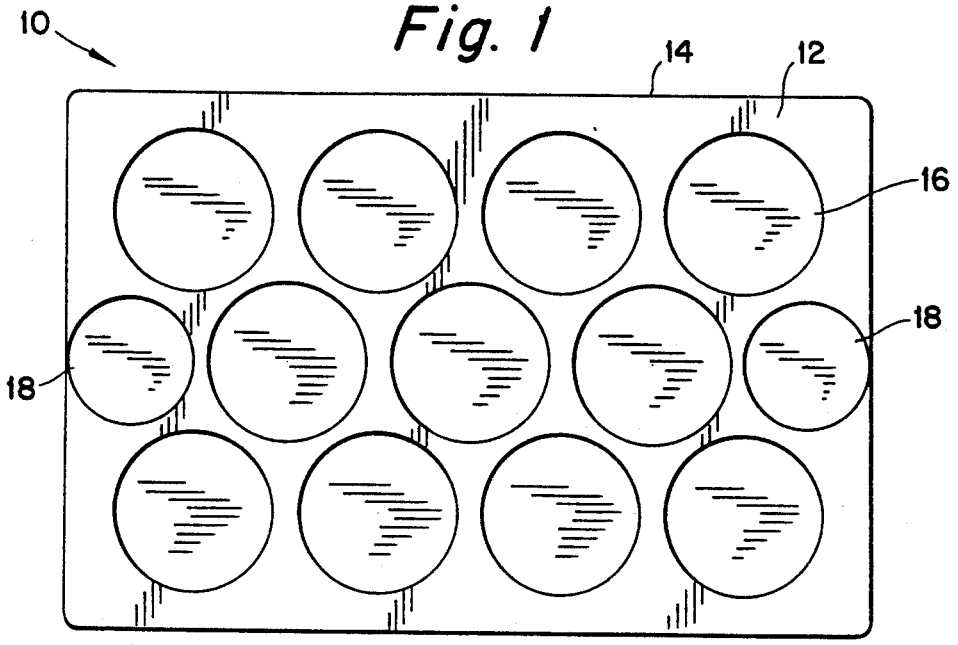
FIG. 1 is a top plan view of a display tray for an eight ounce net weight mushroom package according to the invention.
Figure 2:
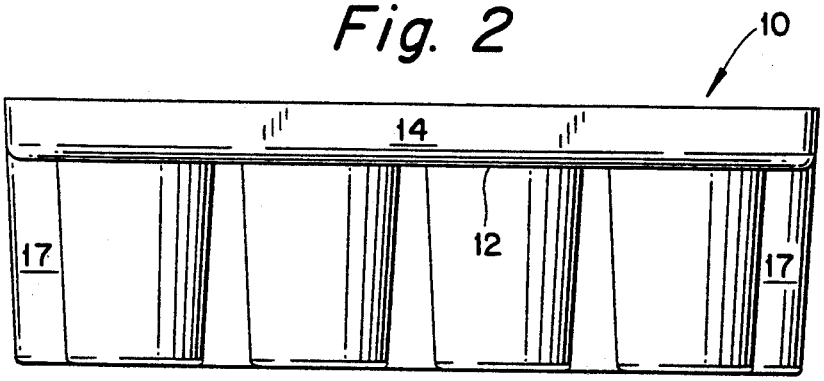
FIG. 2 is a side elevational view of the tray of FIG. 1.
Figure 3:
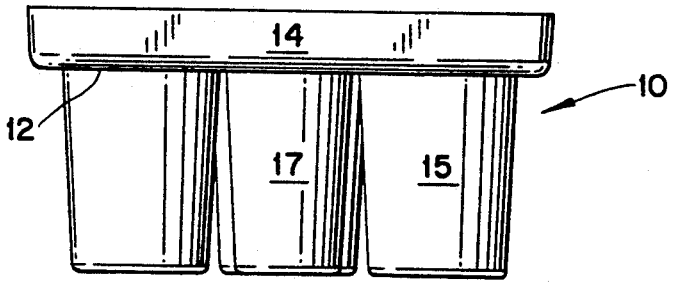
FIG. 3 is an end elevational view of the tray of FIG. 1.

In FIGS. 1-3, the display tray, generally designated 10, a specific embodiment of an eight ounce net weight tray having eleven larger holes 16 and two small holes 18 each located at opposing ends of the center row of holes. Flange 14 defines a matrix around the mushroom crown-supporting surface 12.

The plurality of holes 16 and 18 define a mushroom weight-correlated hole design whereby, when all of holes 16 and 18 each receive a single mushroom, a preselected total weight of the mushrooms is substantially consistently maintained from one mushroom tray 10 to the next.

Figure 4:
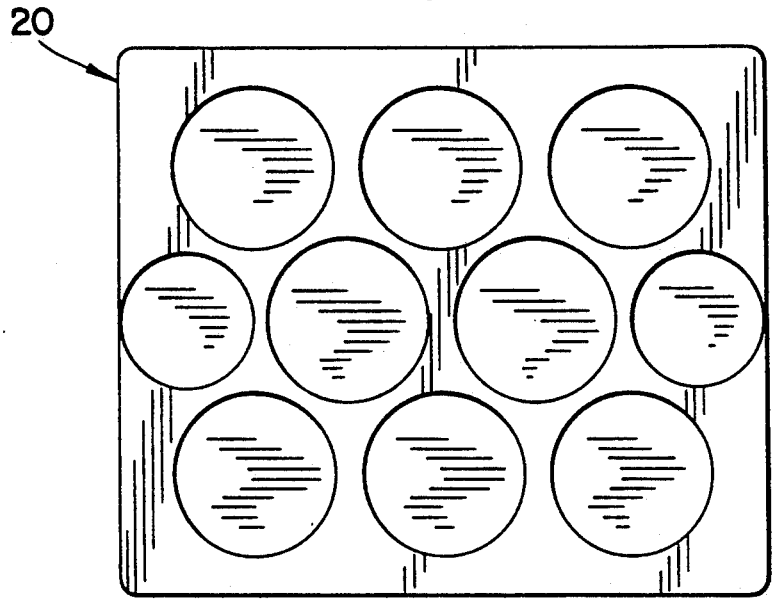
FIG. 4 is a top plan view of a display tray for a six ounce net weight package according to the invention.
Figure 5:
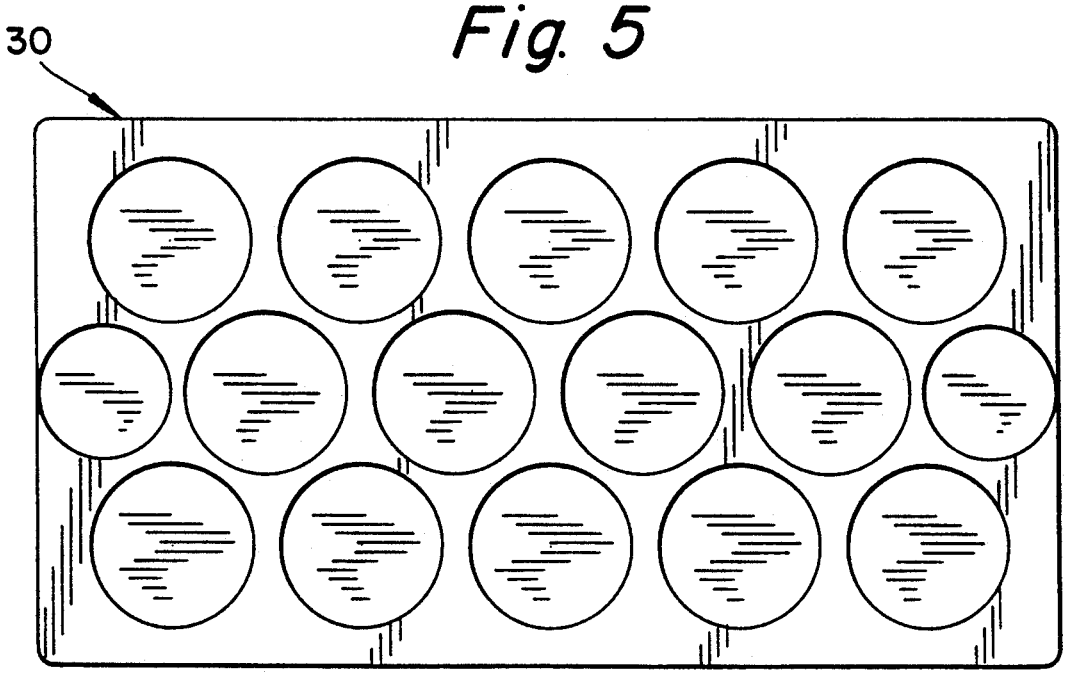
FIG. 5 is a top plan view of a display tray for a ten ounce net weight package made in accordance with the invention.

The embodiments of FIGS. 4 and 5 show a six ounce net weight tray 20 and a ten ounce net weight tray 30, respectively. Trays 20 and 30 each include an upwardly extending flange, a mushroom crown-supporting surface, and wall means defining a mushroom stem-containing chamber as in the eight ounce tray. Each includes continuous, liquid impervious trapezoidal wall structures 15 and 17 as shown in FIGS. 2 and 3.

Trapezoidal structures 17 downwardly project from each base member hole 18 and trapezoidal peripheral wall structures 15 downwardly project from base member holes 16 as shown. Wall structures 15 and 17 form a closed chamber for each of the respective holes 16 and 18, which are laterally spaced with respect to each other across the planar base member of tray 10.

The upper and lower portions of the trays in these particular embodiments are composed of rigid injected molded plastic material. As shown in all the disclosed embodiments, each of the juxtaposed holes 16 and 18 is sufficiently spaced along the base member with respect to each other to form a rim section around each hole as shown. The rim section is effective to support the bottom edge of a mushroom crown around each hole 16 and 18.

As shown, all of the holes 16 and 18 of each row of holes of the embodiments shown in FIGS. 1–5 have the same diameter except for holes 18 located at opposing ends of the middle row of holes. The middle end holes have substantially identical diameters that are smaller than the diameter of the remaining holes 16 in the three rows of holes.

Figure 6:
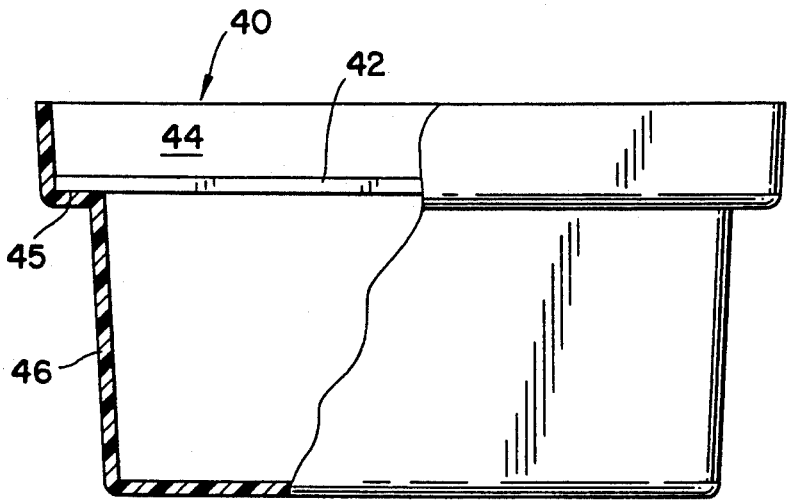
FIG. 6 is a fragmentary sectional view of another embodiment of a mushroom display tray made in accordance with this invention.
Figure 7:
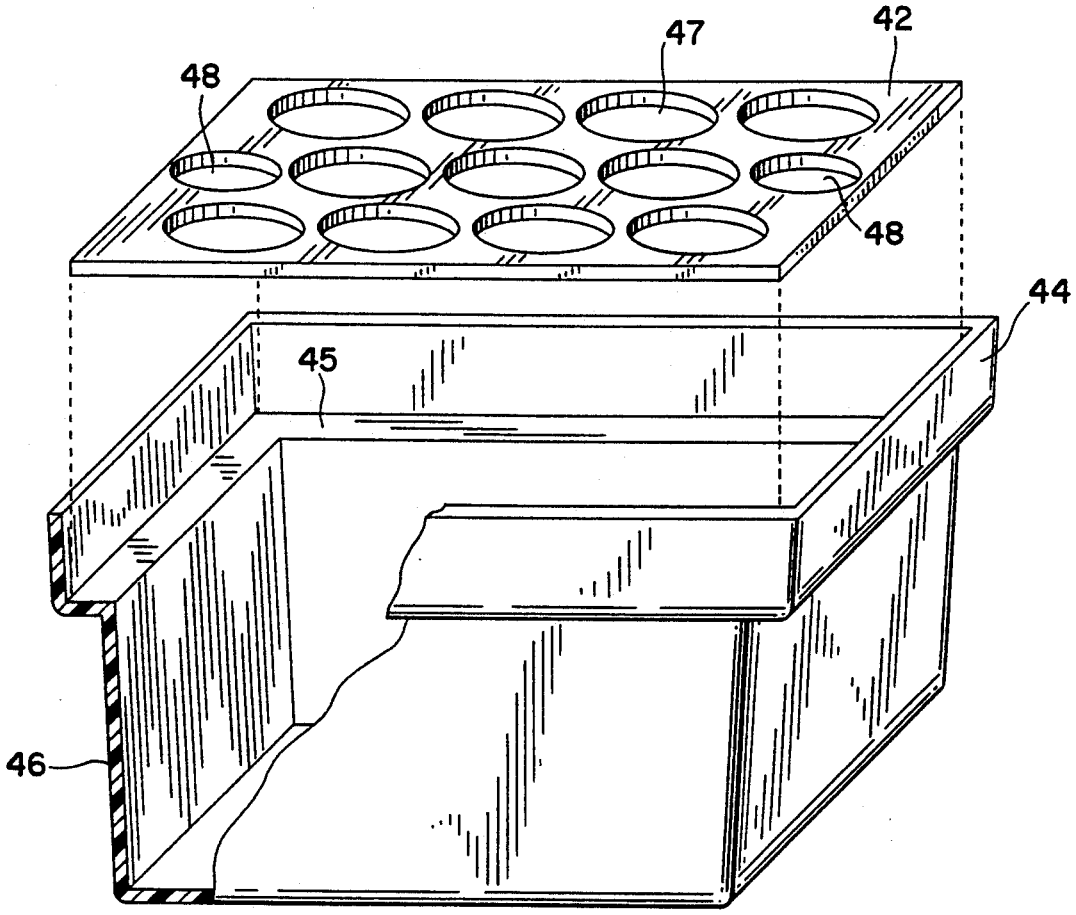
FIG. 7 is an exploded perspective view of the embodiment shown in FIG. 6.

Another embodiment of the invention is shown in FIGS. 6 and 7 wherein wall structure 46 defines a single chamber into which project all the mushroom stems that extend through each hole 47 and 48 of base member 42. Flange 44 and wall 46 define a single integrally formed tray including a shoulder 45 defined between flange 44 and wall structure 46. Shoulder 45 is effective to bearingly suspend rigid planar mushroom crown-support element 42 over the lower tray portion thereby defining a mushroom stem-containing chamber below element 42 and within wall structure 46. Mushroom crown-supporting element 42 includes the plurality of mushroom stem-receiving holes 47 and 48.

Figure 8:
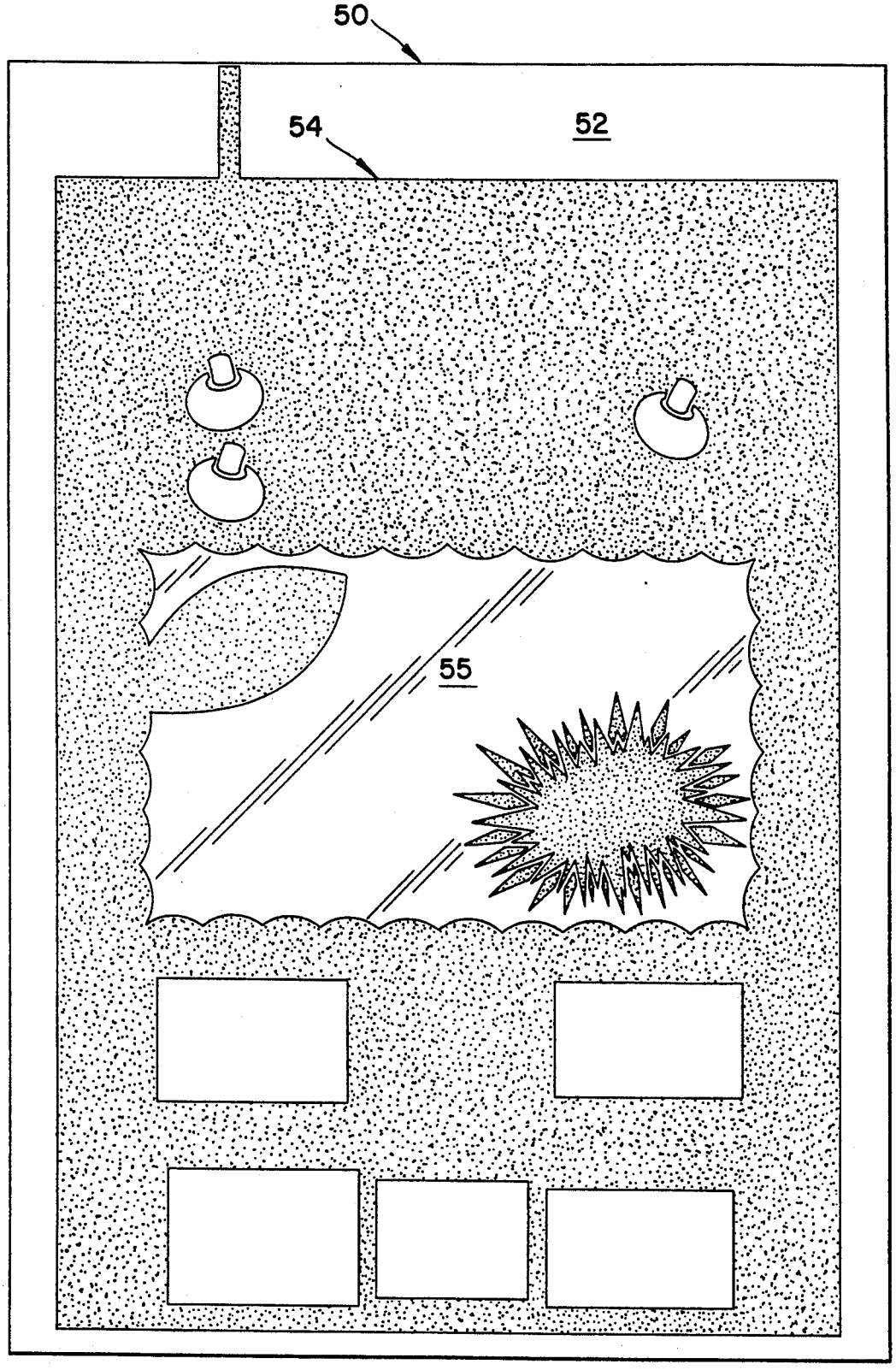
FIG. 8 is a plan view of an overwrap sheet of material used to form a package with a mushroom display tray of the invention.

Each of the trays disclosed in FIGS. 1–7 is overwrapped with a sheet 50 of wrapping material shown in FIG. 8. A rigid tray, such as shown in FIGS. 1–7, is overwrapped with the thin, flexible transparent wrapping material having a clear border 52 and an opaque section 54. Clear center portion 55 is disposed over the mushroom crowns with the connected stems received by each hole.

Sheet 50 of heat sealable wrapping material is disposed contiguously over the mushroom crowns, the tray flange structure, and is then sealed along the lower stem-containing portion formed either by the single chambers 15 and 17 as shown in the tray embodiments of FIGS. 1–5, or around lower tray portion 46 of the embodiment of FIGS. 6 and 7.

In this specific embodiment, opaque portion 54 registers with the outer peripheral edge section including either flange 14 or 44 of the respective embodiments as shown. Further to this specific embodiment, the mushrooms are whole and each includes the mushroom crown, the mushroom stem, and root system. Clear central portion 55 displays only the mushroom crowns while opaque portion 54 masks the edge section of each tray from view.

ADVANTAGES OF THE INVENTION

With the root system of the mushrooms attached, the packaged mushrooms will remain alive and fresh over a longer period of time. With moisture, nutrients, and soil particles left on the roots, the product freshness is enhanced for the end consumer.

With the package of the invention, the consumer may add water to the liquid impervious cells to further extend the life of the mushrooms after purchase and opening of the package.

With the package design of this invention, the mushrooms may be picked off the bed directly into the consumer pack and never touched again because the roots are not separated from the stems. Whole mushrooms are placed in the individual cells with the roots in liquid and the mushroom cap firmly fitted onto the rim surface around each opening into the cell chamber.

With the unique packaging of this invention, the mushrooms need be handled only once during picking thereby overcoming a major problem of extending the mushroom shelf-life. The number and size of cells and openings consistently provide the proper total net weight of mushrooms for the consumer from one package to the next.

The cells may be partially filled with liquid so that the roots will continue to receive moisture and nutrients and will continue to grow within the package. However, due to vacuum cooling refrigeration, the mushrooms grow very slowly and therefore will not cause undue pressure within the overwrap material.

A further advantage of the invention is that the configuration of the weight-correlated cell pattern makes the mushrooms look good and tightly packed within each package. Each package is therefore very attractive while providing a significant functional shelf-life advantage to the consumer.

Although the packages are particularly designed for whole mushrooms including the root system, it is conceivable that the packages be used for cut mushrooms. In either case, the stem-containing cell or chamber encloses the liquid and nutrients so that the stem portions remain moist and the mushroom crowns maintain their white color for a longer period of time.

An advantage to the mushroom grower and picker includes an accelerated picking time because the worker can use both hands to place mushrooms in the tray. Furthermore, the worker is able to pick the mushrooms that are ripe because these are the only ones that can be successfully placed in the container. A ripe mushroom necessarily has a crown spread in a particular fashion so that it may be properly picked and placed in the package. Consequently, the package design of the invention will train the worker in picking the ripe mushrooms. In contrast, green mushrooms are often found in bulk packaged mushrooms in the packing industry using prior art procedures.

While the mushroom display tray and package have been shown and described in detail, it is obvious that this invention is not to be considered as limited to the exact form disclosed, and that changes in detail and construction may be made therein within the scope of the invention without departing from the spirit thereof.

Having thus set forth and disclosed the nature of this invention, what is claimed is:

1. A display tray of mushrooms, said tray comprising:

a) container means accommodating a plurality of contiguously disposed mushrooms and including an upper portion displaying mushroom crowns and a lower portion containing mushroom stems extending from said mushroom crowns, b) the upper portion including an outer peripheral edge section and an upper surface disposed around each of a plurality of holes which receive stems of said contiguously disposed mushrooms, c) the outer peripheral edge section including an upwardly extending flange means that defines a matrix around the upper surface, d) said plurality of holes defining a mushroom weight-correlated hole design whereby a preselected total net weight of the mushrooms is substantially consistently maintained from tray to tray when filled with a same arrangement of mushrooms, e) said lower portion including closed, liquid impervious wall means defining chamber means that receive each mushroom stem extending through each said hole of the weight-correlated hole design from a mushroom crown disposed contiguously to the upper surface, f) said mushrooms and container means being overwrapped by a thin, flexible transparent wrapping material.

2. A display tray as defined in claim 1 wherein said upper and lower tray portions are composed of rigid material.

3. A display tray as defined in claim 1 wherein said wall means defines a single chamber which receives all the mushroom stems that extend through each respective said hole.

4. A display tray as defined in claim 3 wherein said flange means and said wall means define a unitary tray including shoulder means defined between said flange means and said wall means, said shoulder means being effective to bearingly suspend said upper portion defined by a rigid planar mushroom crown-supporting element over said lower tray portion to define said mushroom stem-containing chamber therebelow, said mushroom crown-supporting element includes said plurality of mushroom stem-receiving holes.

5. A display tray as defined in claim 1 wherein said upper and lower tray portions define a unitary tray structure having a planar base member with said peripheral upwardly extending flange means and said plurality of holes are laterally spaced with respect to each other across the planar base member, said wall means includes a peripheral wall structure downwardly projecting from each base member hole to form a closed chamber associated with each said hole.

6. A display tray as defined in claim 5 wherein each said peripheral wall structure includes a continuous trapezoidal wall with each said base member hole defining an outer circumference of a trapezoidal base.

7. A display tray as defined in claim 6 wherein the tray is composed of rigid injected molded plastic material.

8. A display tray as defined in claim 1 wherein each said juxtaposed hole is sufficiently spaced from adjacent holes along the base member to form a rim section around each said hole, each said rim section being effective to support a bottom edge of a mushroom crown around each said hole.

9. A display tray as defined in claim 1, wherein said mushroom weight-correlated hole design includes sixteen holes to produce a ten ounce net weight package of mushrooms.

10. A display tray as defined in claim 1, wherein said mushroom weight-correlated hole design includes thirteen holes to produce an eight ounce net weight package of mushrooms.

11. A display tray as defined in claim 1, wherein said mushroom weight-correlated hole design includes ten holes to produce a six ounce net weight package of mushrooms.

12. A display tray as defined in claim 1, wherein said matrix forms a rectangle, and said mushroom weight-correlated hole design includes three rows of holes disposed parallel to long sides of said rectangle.

13. A tray as defined in claim 12, wherein all of the holes of each said row of holes have a diameter that is the same except for the hole at each end of the middle row of holes whereby these two end holes have substantially identical diameters that are smaller than a diameter of all remaining holes in said three rows of holes.

14. In a package having a rigid tray containing contiguously disposed mushrooms overwrapped by a thin, flexible transparent wrapping material, the combination comprising:

a) said rigid tray including an upper mushroom crown-displaying portion and a lower mushroom stem-containing portion, b) the upper mushroom crown-displaying portion including an outer peripheral edge section and an upper mushroom crown-supporting surface disposed around each of a plurality of mushroom stem-receiving holes, c) the outer peripheral edge section including an upwardly extending flange means that defines a matrix around the mushroom crown-supporting surface, d) said plurality of holes defining a mushroom weight-correlated design whereby, when all of said holes each receive a single mushroom, a preselected total net weight of the mushrooms is substantially consistently maintained when weighing a plurality of said trays filled with contiguously disposed mushrooms, e) said lower mushroom stem-containing portion including closed, liquid impervious wall means defining a mushroom stem-containing chamber for receiving each mushroom stem extending through each said hole of the weight-correlated hole design and from a mushroom crown when disposed contiguously to the upper surface, f) said wrapping material being disposed contiguously over the mushroom crowns, the flange means, and being sealed along the lower stem-containing portion.

15. (Amended) In the combination as defined in claim 14, wherein the wrapping material is heat sealable.

16. In the combination as defined in claim 14, wherein the wrapping material includes an opaque portion that registers with said outer peripheral edge section to display only the mushroom crowns while masking the edge section of the tray from view.

17. In the combination as defined in claim 14, wherein said mushrooms are whole and each includes the mushroom crown, mushroom stem, and root system.

18. In the combination as defined in claim 17, wherein said upper and lower tray portions define a unitary tray structure having a planar base member with said outer peripheral upwardly extending flange means and said plurality of holes are laterally spaced with respect to each other across the planar base member, said wall means includes a peripheral wall structure downwardly projecting from each base member hole to form a closed chamber for each said hole, and each said closed chamber receives a stem with its root system.

19. In the combination as defined in claim 18, wherein said weight-correlated hole design includes either sixteen holes to produce a ten ounce net weight package of mushrooms, or thirteen holes to produce an eight ounce net weight package of mushrooms, or ten holes to produce a six ounce net weight package of mushrooms.

20. A container for the storage and transportation of mushrooms, said container comprising:

a) a base member having an outer peripheral edge portion, a plurality of holes, an upper surface supporting a plurality of contiguously disposed mushroom crowns, and a wall structure containing mushroom stems extending from said mushroom crowns, b) said outer peripheral edge portion including flange means extending along an outer periphery of the base member and projecting outwardly from the upper surface to define a matrix around the upper surface, c) each said Juxtaposed hole being laterally spaced from each said other hole along said upper surface to define a rim section therebetween to contiguously support mushroom crowns of mushrooms disposed in said juxtaposed holes, d) said wall structure including enclosed wall means projecting outwardly from said base member along the entire periphery of each said hole to define a plurality of closed chambers containing said mushroom stems projecting through the holes with crowns of mushrooms resting against said upper surface, e) said wall means being liquid impervious to hold nutrient material for a mushroom, and f) a thin, flexible transparent material disposed contiguously over the mushroom caps disposed on the base member.

* * * * *